US006435382B1

(12) United States Patent
Giblin et al.

(10) Patent No.: US 6,435,382 B1
(45) **Date of Patent: *Aug. 20, 2002**

(54) SPIGOT ASSEMBLY FOR CONTAINER

(75) Inventors: Edward John Giblin, Hopatcong, NJ (US); Mark Douglas Gerhart, Westminster, MD (US); George Richard Trepina, Holland; Eugene Francis Haffner, Waterville, both of OH (US)

(73) Assignee: Unilever Home & Personal Care USA, division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,608

(22) Filed: Jul. 9, 1999

(51) Int. Cl.[7] ..... B67D 3/04
(52) U.S. Cl. ..... 222/509; 222/518
(58) Field of Search ..... 222/509, 518, 222/539; 215/274, 276; 220/319, 220; 217/99

(56) References Cited

U.S. PATENT DOCUMENTS

| | | | | |
|---|---|---|---|---|
| 553,389 A | * | 1/1896 | Brower | 222/509 X |
| D140,804 S | | 4/1945 | Windbiel | |
| 2,713,988 A | * | 7/1955 | Kitterman | 222/518 |
| 3,584,834 A | | 6/1971 | Reid et al. | |
| 4,241,856 A | * | 12/1980 | Otterson | 222/539 |
| 4,345,691 A | | 8/1982 | Burke | |
| 4,452,425 A | * | 6/1984 | Lucking | 222/518 X |
| 4,461,408 A | | 7/1984 | Shepard | |
| 4,901,887 A | | 2/1990 | Burton | |
| 5,143,237 A | | 9/1992 | Lindsey et al. | |
| 5,226,562 A | | 7/1993 | Kirk | |
| D339,022 S | | 9/1993 | McGinnis et al. | |
| 5,299,718 A | | 4/1994 | Shwery | |
| D361,037 S | | 8/1995 | Jonsson | |
| D370,379 S | | 6/1996 | Klein et al. | |
| D373,240 S | | 9/1996 | Parnell | |
| 5,582,329 A | * | 12/1996 | Watson | 222/539 X |
| D391,448 S | | 3/1998 | Winer et al. | |
| 5,829,613 A | * | 11/1998 | Wohlgemuth et al. | 215/256 |
| 5,845,798 A | | 12/1998 | Carrier | |
| 5,897,010 A | | 4/1999 | Soyka, Jr. et al. | |
| D410,845 S | | 6/1999 | Anderson | |

FOREIGN PATENT DOCUMENTS

| | | | |
|---|---|---|---|
| DE | 297 02 661 | * | 5/1997 |
| FR | 1 133 650 | | 3/1957 |
| FR | 1442004 A | * | 2/1966 |
| GB | 6042 Az | * | of 1913 |
| WO | 95/22504 | | 8/1995 |
| WO | 97/27113 | | 7/1997 |
| WO | WO 01/04006 | * | 1/2001 |
| WO | WO 01/04016 | * | 1/2001 |

OTHER PUBLICATIONS

Tide with Bleach Alternative (300 fl. oz) bottle, sold by a third party prior to invention of the present invention, (photographs of front, rear, top, side and bottom views).

Coleman square blue container, side and front views.

Reliance round blue container, photographs of bottom and spout (inside).

Aqua–tainer container from Internet.

(List continued on next page.)

*Primary Examiner*—Kenneth Bomberg
(74) *Attorney, Agent, or Firm*—Gerard J. McGowan, Jr.

(57) ABSTRACT

A valve assembly and an ergonomic, convenient to use container for liquids such as heavy duty detergents, fabric softeners and the like, which includes the valve assembly. The valve assembly preferably includes at least two separate pieces, (i) a valve, and (ii) a collar for securing the valve to the container.

29 Claims, 10 Drawing Sheets

OTHER PUBLICATIONS

Prior 2 pc. collars (2 photos, each of 3 2 pc. collars).
PCT Search Report in PCT/EP00/06251 mailed Oct. 30, 2000.
Picture No. 1: tap & pressed sleeve combination (used for wine bag–in–box) (top separate components, bottom–assembled).
Picture No. 2: tap & threaded collar combination (assembled components only).
Picture No. 3: tap, threaded collar & pressed sleeve combination (top–assembled, bottom–separate components).

* cited by examiner 10
44
10
46
42
58
56
52
40
22
48
50
22
60
26
28
36
20

FIG.10
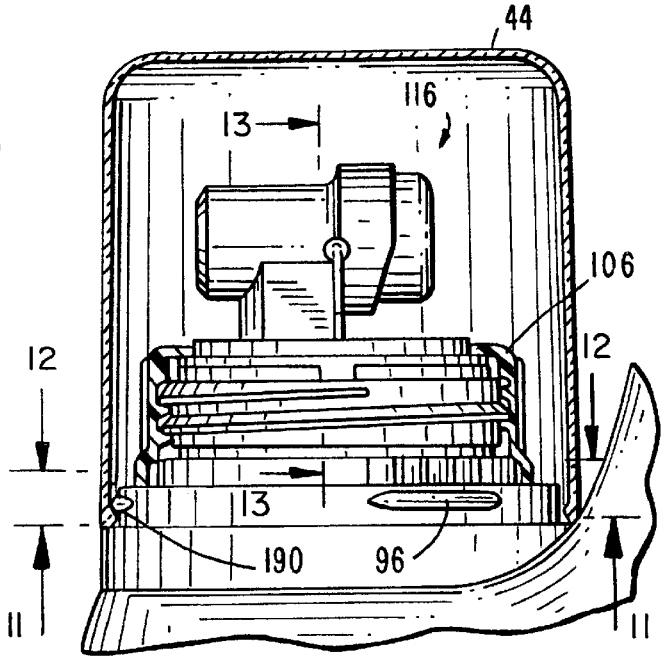
FIG.11
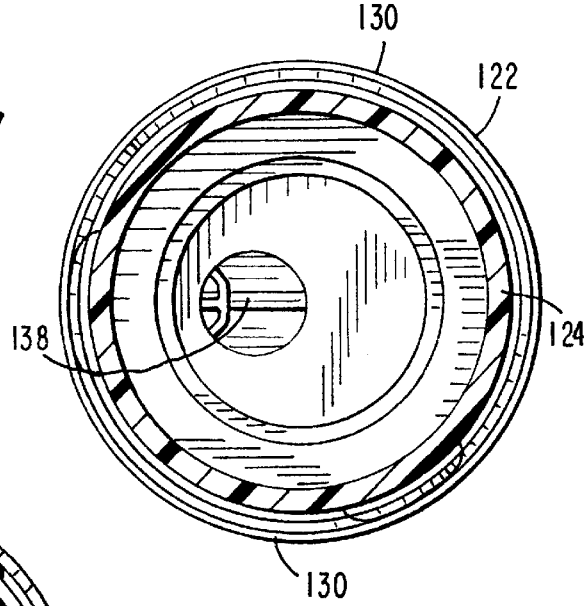
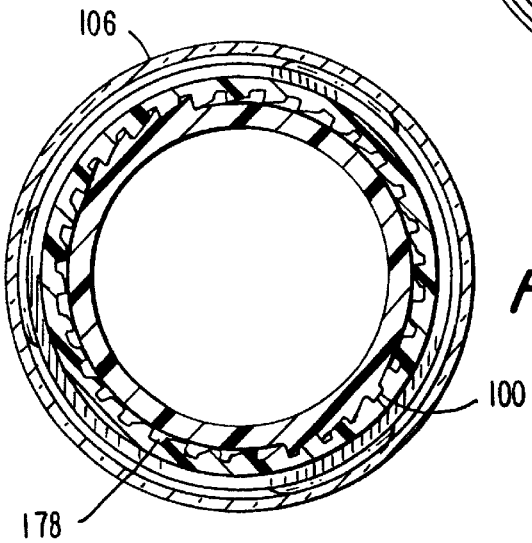
FIG.12

SPIGOT ASSEMBLY FOR CONTAINER

BACKGROUND OF THE INVENTION

There has been a surge in popularity of the so-called "club" stores wherein consumers often purchase goods in larger quantities than has typically been the custom. The popularity of these outlets and the increased demand for larger volume units for selling consumer products has led to a need for improved packaging.

The need for updated packaging is particularly difficult to satisfy for heavy duty liquid detergents and other liquid consumer products since the weight of the enhanced volume of liquid product poses formidable challenges to the packaging engineer. For instance, despite its larger size the package must still permit convenient dispensing by consumers, who range in age from children through middle aged adults and up into the older population. In addition, with the larger volume of liquid product, the difficulties in ensuring structural integrity of the package are markedly increased. Moreover, it is desirable to provide such packaging at a low cost to consumers.

Various containers for carrying larger volumes of liquids by consumers are known.

Prior to the invention of the present invention, Chilton Products, Chilton, Wis. 53014 sold a 320 fluid ounce container (2.5 gallons) having a top wall with a centrally disposed handle, a vent opening and cap on one side of the handle and a dispensing opening and closure on the other side of the handle.

Prior to the invention of the present invention, a product called "Tide with Bleach Alternative" was sold in a 300 fluid ounce container having in a top wall, a centrally disposed handle, a vent and vent closure on one side of the handle and a spigot covered with a measuring cup on the other side of the handle.

SUMMARY OF THE INVENTION

The present inventors have discovered an ergonomic, convenient-to-use container for liquids such as heavy duty detergents, fabric softeners and the like.

In a first embodiment, the container includes a dispensing opening, a closure and a plurality of walls. At least one of the walls includes a non-uniform surface structured so that the dispensing closure can be disposed on the surface when the container is in its dispensing position. In a still preferred embodiment, the non-uniform surface is etched into the wall, preferably by etching into the mold which forms the wall. In a still more preferred embodiment, the closure is a measuring cup. The non-uniform surface preferably assists in retaining the measuring cup on the wall even if the wall is comprised of a material, such as thermoplastic, which would otherwise promote sliding of the closure on the wall in the event of any movement of the container.

In another preferred embodiment, the top wall of the container includes a vent, a vent cap forming a closure for the vent, a handle, a pouring aperture and a pouring closure covering the pouring aperture. The top surfaces of the vent cap, the handle and the pouring closure are generally parallel, and the height of the top surfaces of the vent cap and the pouring closure are within an inch of the height of the top surface of the handle. The presence of generally parallel surfaces at the top of the container which are of the same or similar height promotes stacking of the shipping containers, since an uneven effective top surface of the container would tend to result in uneven stacking.

Preferably, the closure for the pouring aperture includes a measuring cup.

In another preferred embodiment, the top wall of the container includes a handle extending from a handle base within the top wall. A pouring aperture is surrounded by a pouring aperture base which also extends from the top wall. In accordance with this preferred aspect of the invention, the pouring aperture base is isolated from the interior handle base by the handle base exterior. By isolating the interior handle base areas from the base of the pouring aperture, it can be expected that if any residual liquid product is present in the pouring aperture base area after the container has been used, the isolation of such area from the interior handle area will diminish the likelihood that liquid product will find its way to the handle and inconvenience the consumer.

In another preferred embodiment, the invention comprises a valve assembly which preferably includes at least two separate pieces, (i) a valve and (ii) a collar for securing the valve to the container. The invention also comprises a container having the valve assembly. The valve may include a base, a valve head, a valve stem and a resilient valve actuator.

In its preferred form, the container of the invention includes in its top wall, a medial handle, a pouring aperture and over-fitting measuring/closure on one side of the handle, and a vent opening and vent cap on the opposite side thereof. Preferably the container includes at least six sides, more preferably at least eight sides, to enhance structural stability while at the same time permitting use of the minimal amounts of resin and other structural components possible. The at least 8 sides are believed to provide structural strength and bulge resistance.

In another preferred embodiment, the handle is generally curved, which applicants anticipate will result in improved compressive strength. It is believed that the presence of soft radii rather than sharp radii will enhance the compressive strength of the container, particularly relative to containers in which the handle contains sharp angles.

For a more complete understanding of the above and other features and advantages of the invention, reference should be made to the following Detailed Description of Preferred Embodiments and to the accompanying drawings.

BRIEF DESCRIPTION OF THE DRAWINGS

FIG. 10 is a partial elevational view showing particularly the pouring opening, spigot and measuring cup/closure of the invention.

FIG. 11 is a cross section along the lines 11—11 of FIG. 10.

FIG. 12 is a cross section along the lines 12—12 of FIG. 10.

DETAILED DESCRIPTION OF THE INVENTION

Figure 1:
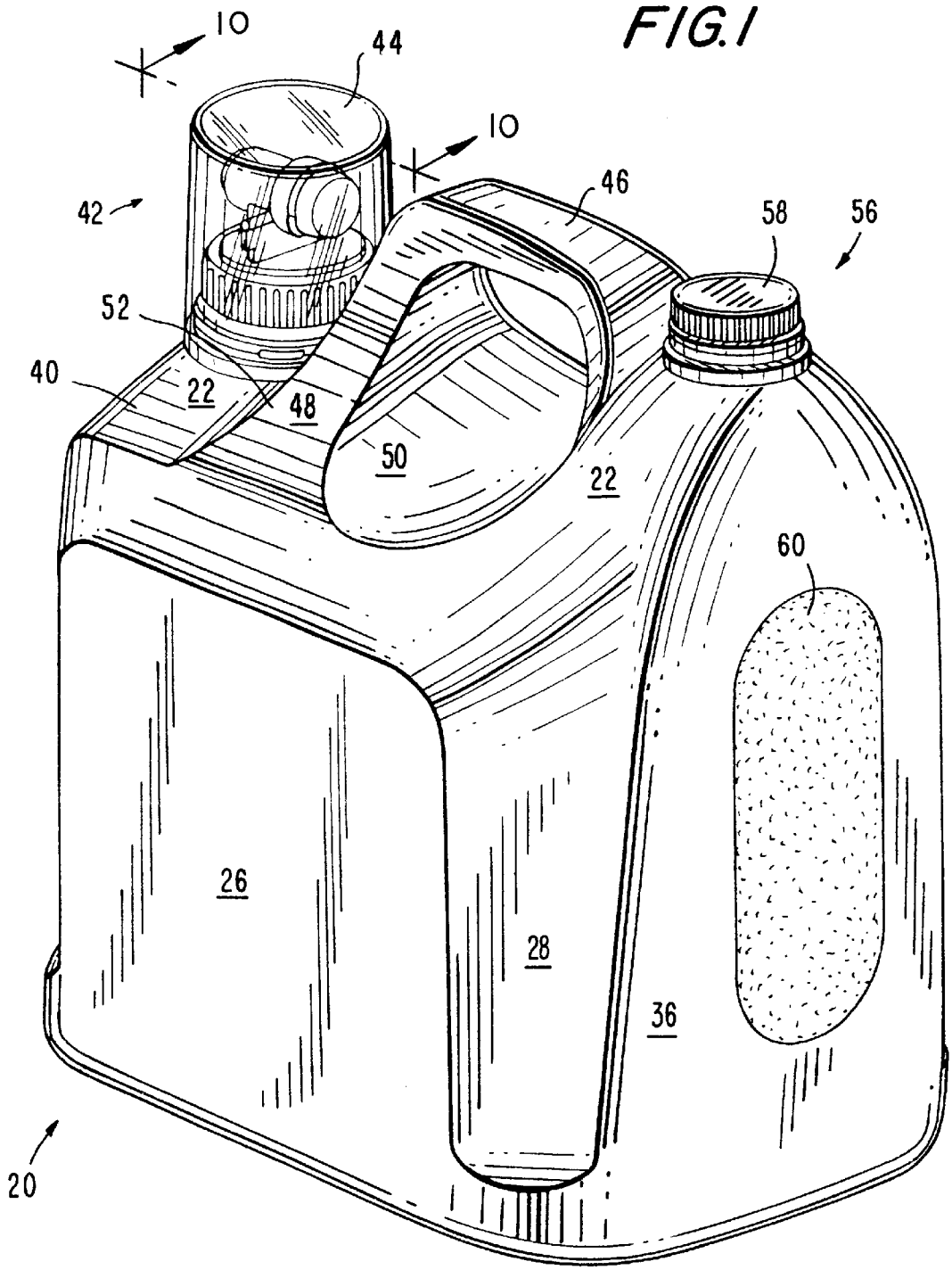
FIG. 1 is a perspective view of a container according to the invention.

Container or bottle 20 includes top wall 22, front wall 24, side walls 26, 28, 30, 32, 34 and 35, and rear wall 36.

Bottom wall 38 supports the container.

Top wall 22 includes a recessed area 40 in which is disposed valve or spigot apparatus 42 and closure/measuring cup 44, which will be described in greater detail below. Medially disposed with respect to valve or spigot assembly 42 is handle 46 which is integral with top wall 22. Handle 46 includes a base 48 having an interior aspect 50 and an exterior aspect 52. The interior of handle 46 is generally oval shaped as can be seen e.g., in FIG. 2.

Disposed laterally to handle 46 and on an opposite side from spigot assembly 42 is vent 56 and vent cap 58. The height of the highest point of wall 22 adjacent vent 56 is considerably higher than that in recessed area 40. Rear wall 36 includes oval etched area 60. The etching provides a non uniform or rough surface for reasons which will be discussed below.

Figure 2:
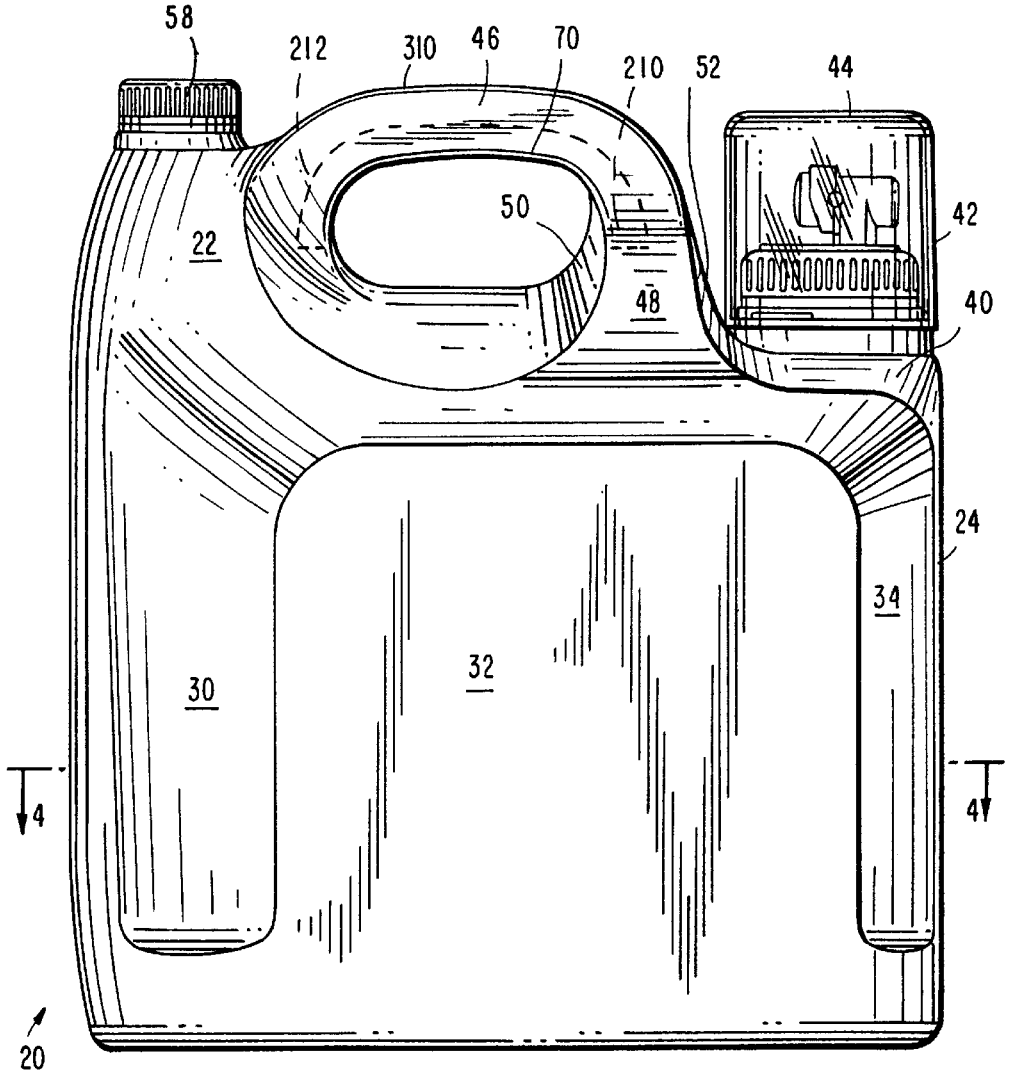
FIG. 2 is a side elevational view of the container of FIG. 1.
Figure 3:
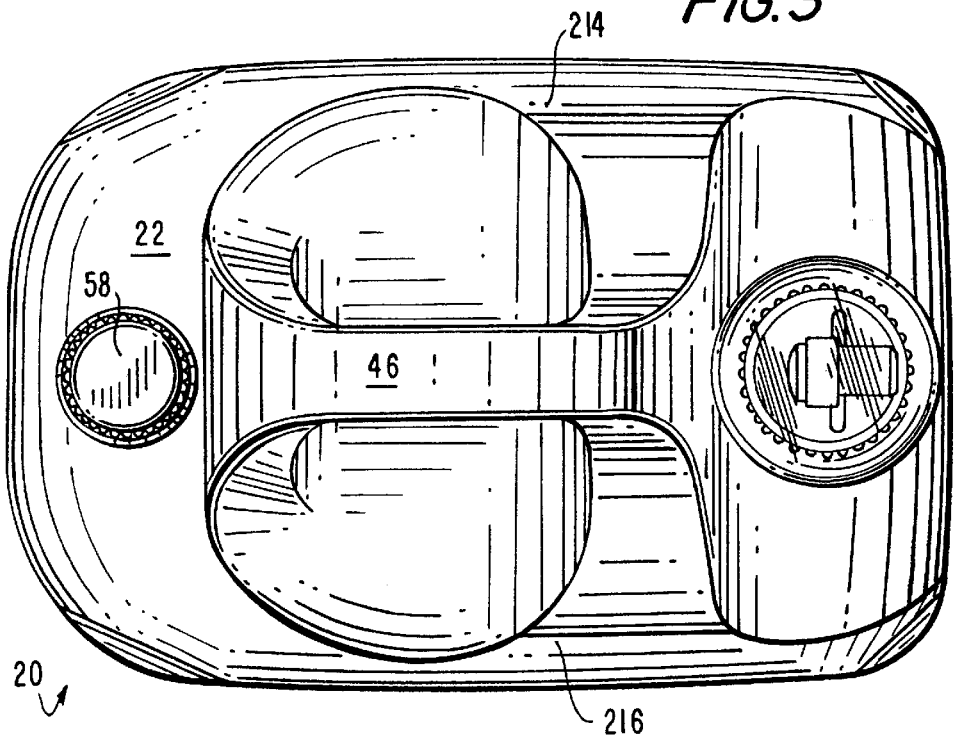
FIG. 3 is a top plan view of the container of FIG. 1.
Figure 4:
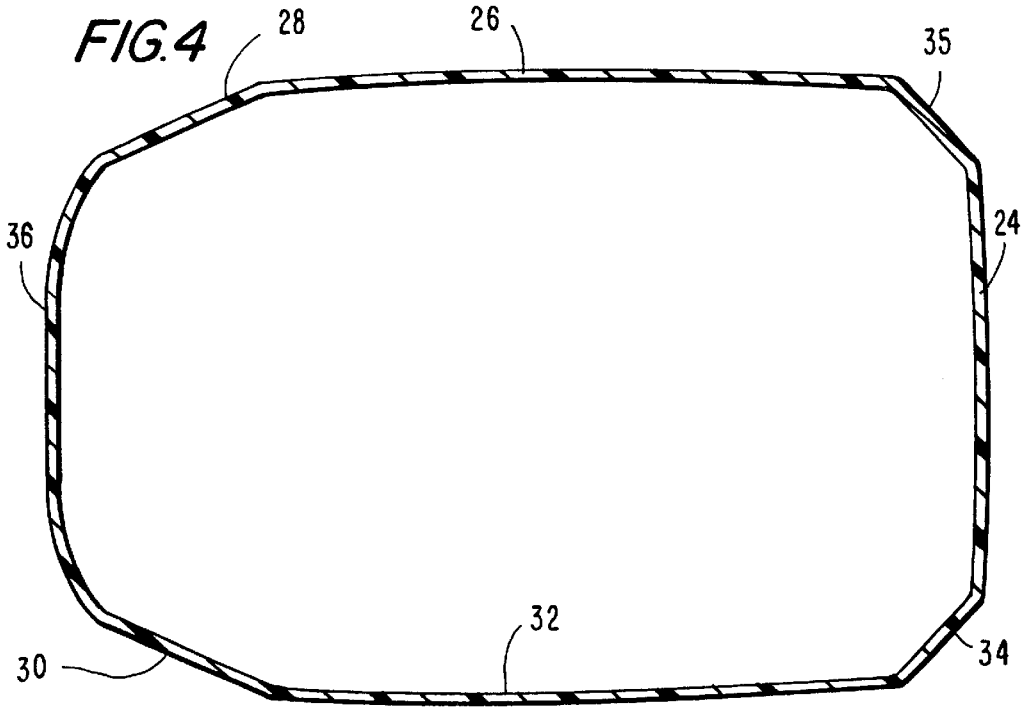
FIG. 4 is a cross section along the lines of 4—4 of FIG. 2.
Figure 5:
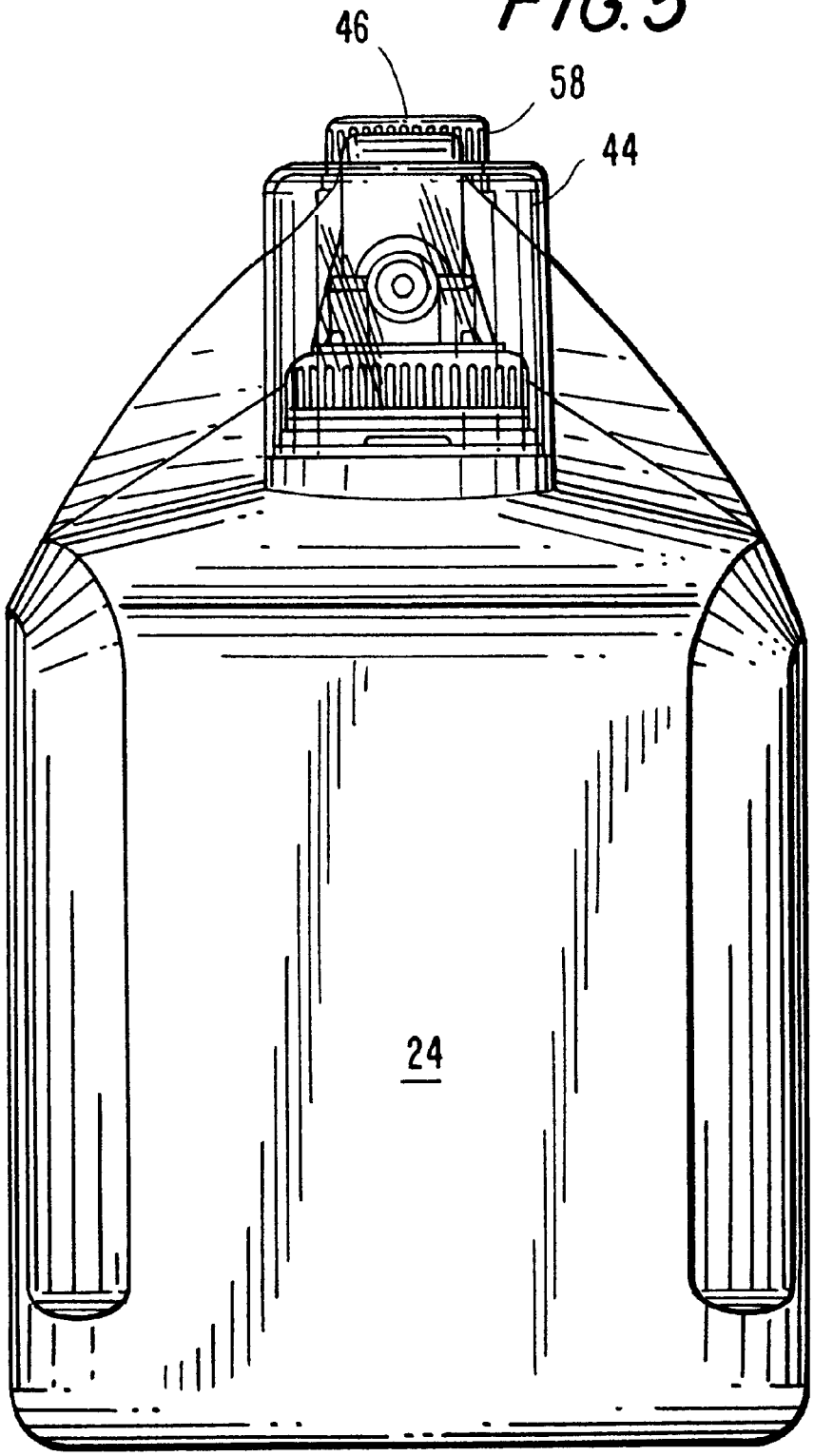
FIG. 5 is a front elevational view of the container of FIG. 1.
Figure 6:
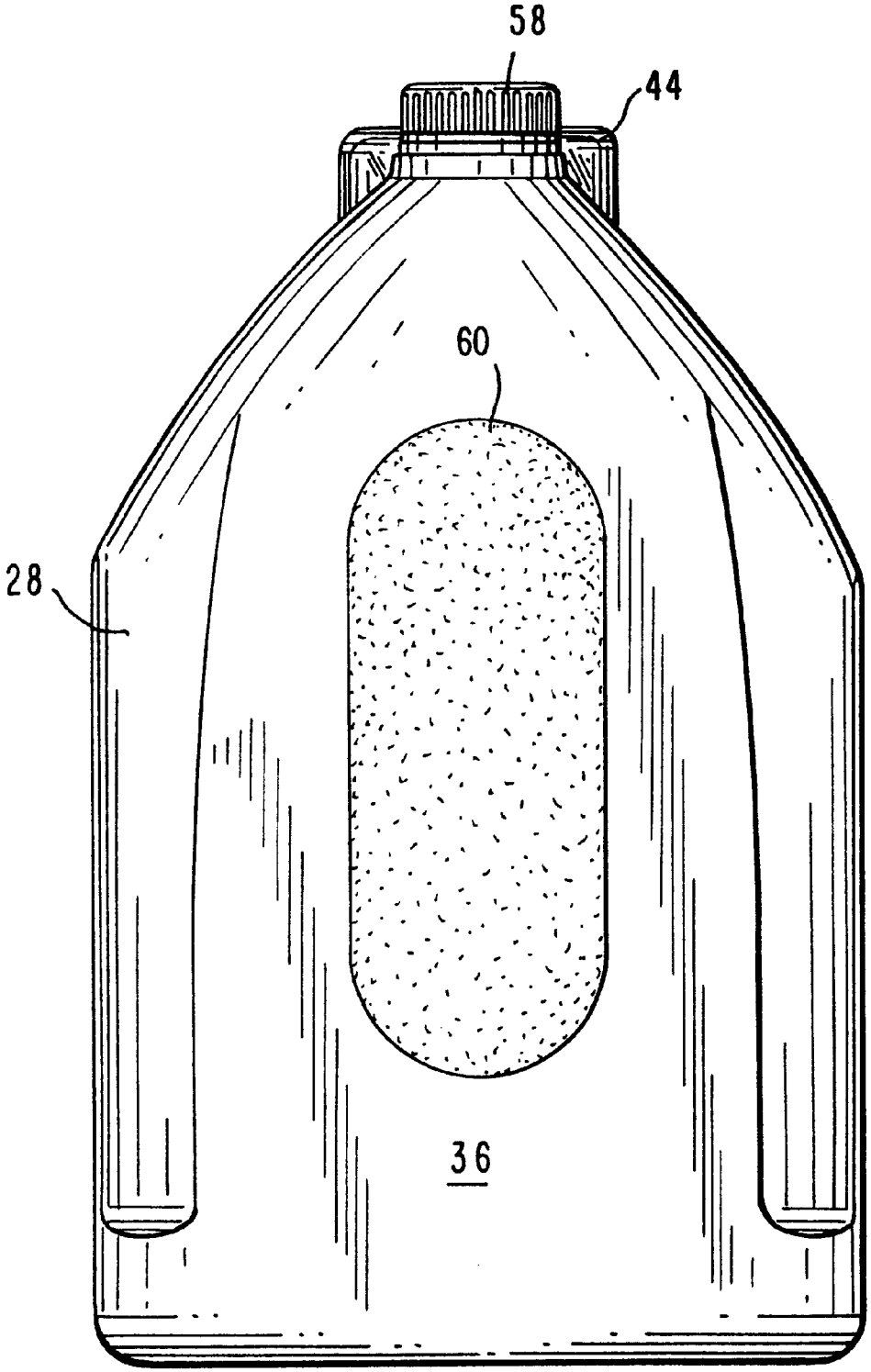
FIG. 6 is a rear elevational view of the container of FIG. 1.

As seen particularly in FIG. 2, the recessed area 40 in which the spigot assembly 42 is disposed is isolated from the interior aspect 50 of handle 46 by handle base 48. It is anticipated that isolation of the spigot area from the interior of the handle will prevent itinerant liquid product from migrating from the spigot area to the interior of the handle. This can be expected to make it less likely that the consumer will find liquid product on his or her hand at the conclusion of the pouring operation.

As can be seen especially in FIG. 2, the top surfaces of measuring cup 44, handle 46, and vent cap 58 are generally parallel. Moreover, the heights of the top surfaces of the measuring cup 44 and the vent cap 58 are independently within one inch of the top surface of handle 46, especially within ¾ of an inch of the top surface of handle 46, and most preferably within ½ inch of the top surface of the handle 46. Keeping the top surfaces parallel and at approximately the same height facilitates the stacking of containers in that the effective top surface of the container seen by a container stacked on top of it will be more or less even whereby to prevent uneven stacking of the containers.

The large oval handle aperture 70 facilitates gripping of the container by the consumer; there are no uneven edges to cause the consumers discomfort. This is particularly important given the substantial weight which the container is designed to contain.

The handle and top wall of the container body include several features which it is believed contribute to an improved compressive strength. The forward and rear walls 210, 212 of the handle are generally curved rather than having rectilinear sides which meet at relatively sharp angles with each other or with the top wall 22. That is, the handle of this aspect of the present invention comprises arcs or substantially straight lines connected by arcs rather than substantially straight lines intersecting other substantially straight lines to form sharp angles. This refers not merely to the edges of the handle on the inside and outside surfaces but also to angles which would be formed at intersections of imaginary midlines, such as midline 310, of the handle. Thus the handle should have arcs rather than sharp angles both on its inside and outside surfaces as well as at the intersections of imaginary midlines. Moreover, the base 48 of the handle at its front is immediately adjacent the base of the pouring opening, so it is disposed in an area of the top wall having a particularly sturdy structure.

Other features believed relevant to compressive strength include the fact that the base of the handle 48 at its front is in contact with the top wall of the container at a large number of points, extending e.g., from reference 214 on one side to 216 on the other, so that any force transmitted from above will be dissipated rather than concentrated at a few points. This is believed to make the container top wall, and therefore the container as a whole, less susceptible to failure. Indeed the width of the base at the handle's front end (measured along a horizontal axis, e.g., parallel to the top surface of the measuring cup/valve closure) is at least twice the width of the handle, preferably at least three times, still more preferably at least four or five times the width of the handle (also measured along a horizontal axis). In addition, the rear end of the handle merges curvedly with the elevated top wall 22 adjacent to the vent cap so that, again, any force transmitted from the handle is dissipated over a large area rather than concentrated at a few points.

As can be seen from the figures, the preferred package includes eight vertically extending side panels, including the front and rear walls. Use of six or more, especially use of eight or more side walls or panels is believed to enhance the compression strength of the container and to permit the use of less resource, e.g. thermoplastic polymers, in its manufacture. Use of less resource in manufacture in turn leads to less waste material after the useful life of the container is complete.

Figure 7:
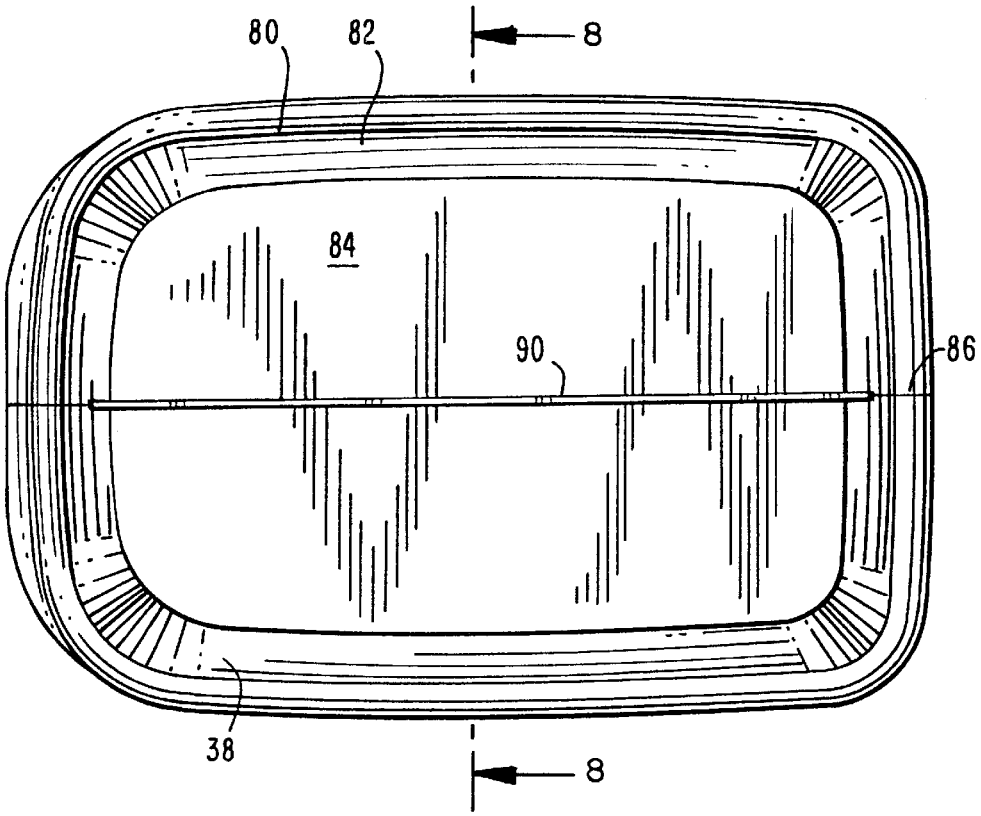
FIG. 7 is a bottom plan view of the container of FIG. 1.
Figure 8:
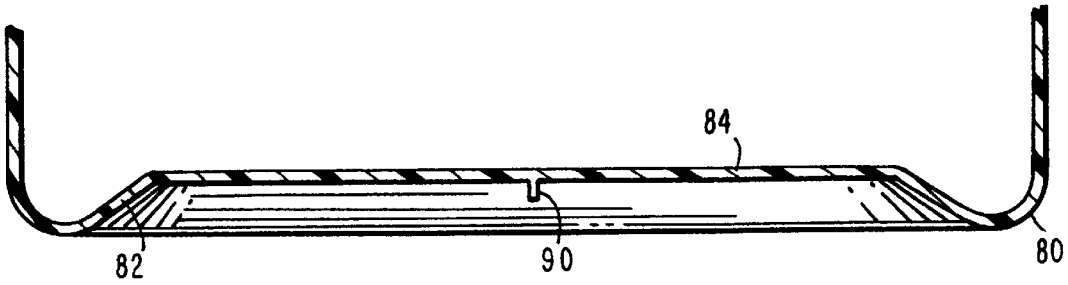
FIG. 8 is a cross section along the lines of 8—8 of FIG. 7.

Referring especially to FIGS. 7 and 8, bottom wall 38 includes outer rim 80 which comprises the primary support for the container. Heel 80 extends downwardly further than other aspects of the bottom wall 38. Wall 38 may include the base push-up construction shown in the FIG. 7 wherein an angled portion 82 is disposed inwardly of first ring 80 and medial aspect 84 of wall 38 is disposed further inwardly.

Parting line 86 (FIG. 7) is an artifact of container manufacture when the container is blow molded. Parting line 86 reflects the joining of two halves of the mold used to make the container. It may be desirable, as illustrated in FIGS. 7 and 8, to have a rib 90 of enhanced thickness and length at the parting line to provide support when the weight of the liquid product pushes downwardly on the medial aspect 84 of bottom wall 38. In such circumstances, rib 90 will assist in supporting the weight of the product. The structural support rib along the middle of the push-up is known per se and is also called the "pinch-off." As the push-up inverts due to the weight of the liquid contents, the rib may contact the flat surface and prevent further inversion of the push-up. Alternatively, there may be a series of parallel grooves in the bottle base's push-up to resist push-up inversion. The base push-up area may have one or two horizontally extending tiers for added strength, or may be waffled for increased strength.

Figure 9:
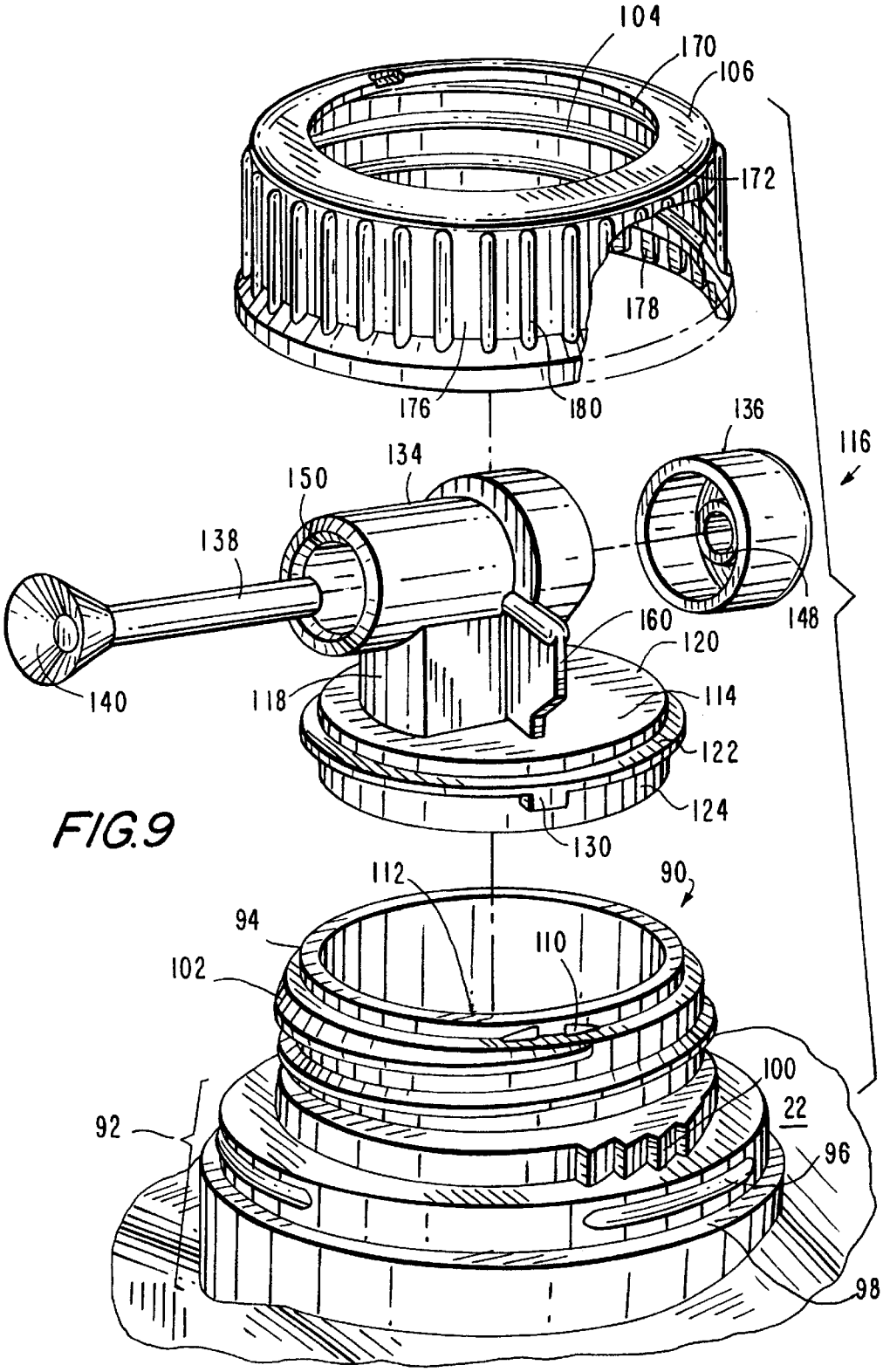
FIG. 9 is an exploded view of the pouring aperture, the pouring base, the pouring finish, the valve assembly and the valve collar of the invention.

Referring particularly to FIG. 9, top wall 22 has disposed therein annular dispensing opening 90. Dispensing opening 90 is supported by base 92 and by finish 94. Base 92 is generally circular and may include a plurality of levels as is illustrated in FIG. 9. In at least one level, elongated tabs 96 which are equally spaced from each other along the circumference of the base, serve to mate with a bead on the measuring cup, as will be described below. Below tab 96 a step 98 is provided in base 92 to support the measuring cup 44 when it is in place over the spigot assembly.

At the bottom of finish 94 are disposed two oppositely positioned sets of ratchets 100. Finish 94 is also provided with external threads 102 for mating with internal threads 104 on valve securement collar 106. Top thread 108 includes mirror image wedges 110, 112 which serve to facilitate alignment of valve base 114 when the spigot is in place by providing lug confining walls.

Valve base 114 includes spigot or valve 116, valve support column 118, spigot support platform 120, outer ring 122 and inner depending ring 124. Spigot support 114 is placed within dispensing aperture 90 by snap fitting inner ring 124 within the mouth of aperture 90. Outer ring 122 includes one or more oppositely disposed depending lugs 130, which are accommodated in a space between each of the mirror image wedges 110, 112. This facilitates the proper alignment of spigot supporting structure 114 and ultimately of spigot 116.

Figure 16:
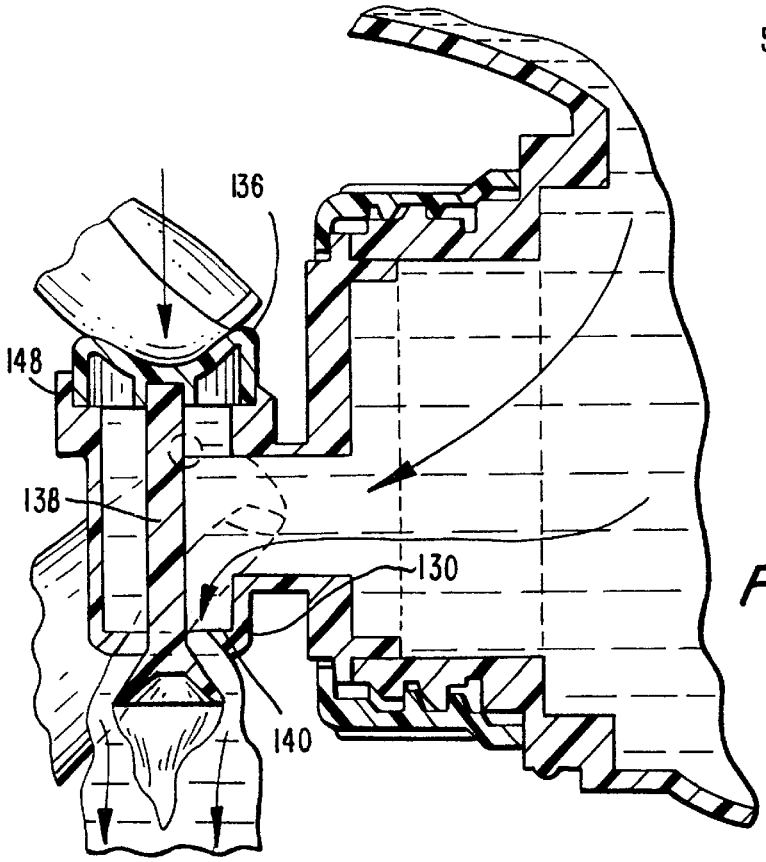
FIG. 16 is a cross section illustrating the pouring of product through the spigot of the present container.

Spigot 116 includes a valve mechanism of a type available from the Davis S. Smith Worldwide Dispensers of Merton, London of Great Britain. The spigot comprises spigot housing 134 resilient actuating button 136, valve stem 138, valve stem gripper 148 and valve 140. Operation of this simple valve is best seen with reference to FIGS. 14 and 16. In order to dispense product, the consumer rests the container on front wall 24 by pivoting the container forward along the front section of ring 80 of bottom wall 38. The consumer dispenses product by pressing the resilient actuator button 136, which receives valve stem 138 in circular retaining structure, gripper 148. Preferably, gripper 148 is also resilient and slightly narrower than the diameter of the valve stem 148. The force applied by the consumer's finger is transmitted through valve stem 138 and forces valve 140 away from valve seat 150. This permits product to flow through the spigot and into the wash, or more preferably, into measuring cup 44.

Gripping wings 160, 162 are disposed on either side of valve housing 134 to permit the consumer to grasp the valve housing with two fingers while applying pressure with the thumb.

Figure 13:
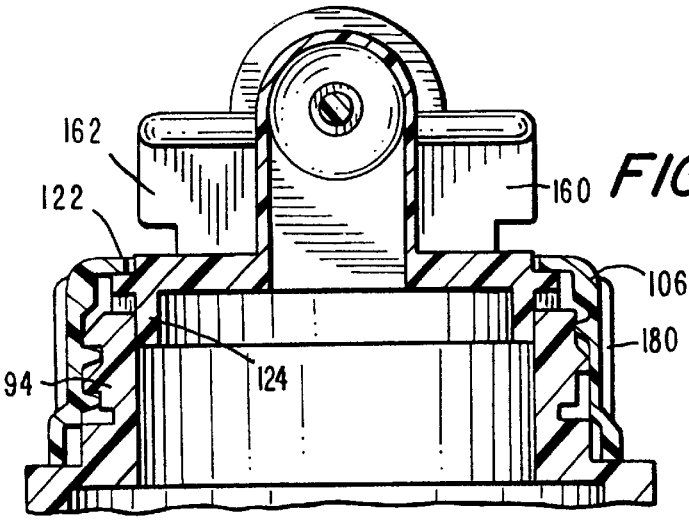
FIG. 13 is a cross sectional view along the lines 13—13 of FIG. 10.

As best seen in FIGS. 9 and 13, the spigot assembly 116 is secured to bottle finish 94 by spigot or valve collar 106. Internal threads 104 mate with external threads 102 on the bottle finish. Opening 170 on the spigot collar permits the spigot to extend outside of the collar. The top of the spigot collar includes flange 172 which rests upon outer ring 122 of the spigot base when the collar is secured in place on the spigot finish. Depending wall 176 of the spigot collar includes in addition to internal threads 104, lugs 178 which mate with ratchet 100 at the bottom of the spigot finish to secure more or less permanently the collar to the container.

The outside of spigot collar 106 may be provided with vertically extending ribs 180 to assist in rotating the collar when it is applied to the container.

Figure 15:
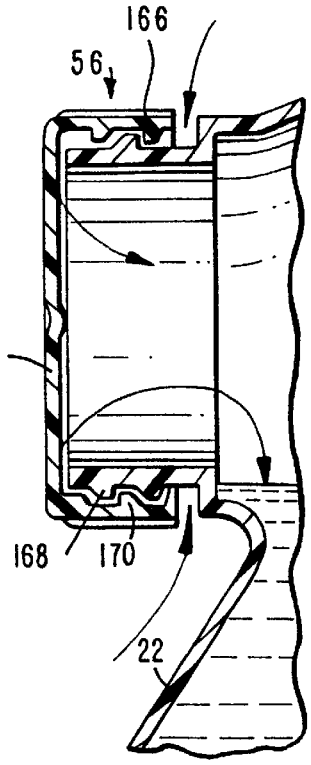
FIG. 15 is a cross section illustrating the venting of product through the vent hole and vent cap of the present invention.

To facilitate dispensing of product, it is preferred that the container include a vent 56 and vent cap 58. The container may also be filled through the vent, if so desired. Vent 56 comprises vent finish 166 which is threaded with external thread 168 to mate with internal thread 170 on vent cap 58. As best seen in FIG. 15, loosening of vent cap 58 permits air to flow inwardly, as illustrated by the arrows in FIG. 15, and thereby to replace with air the volume of product lost when product is dispensed. In the illustrated embodiment, the vent opening finish is externally threaded and its external threads mate with internal threads on the vent closure. Alternatively, the vent closure may be a push/pull closure, disc-top or snap-top closure. Preferably, the cap employs a linerless seal (e.g., valve seal). However, the venting closure may have either a lined or linerless seal and have either a continuous thread or an interrupted thread to assist in venting air into the bottle upon slight twisting. The venting closure may have an anti-removal lug stopping against a lug on the bottle finish, such engagement occurring after ¼ to ¾ turns to loosen the closure.

Figure 14:
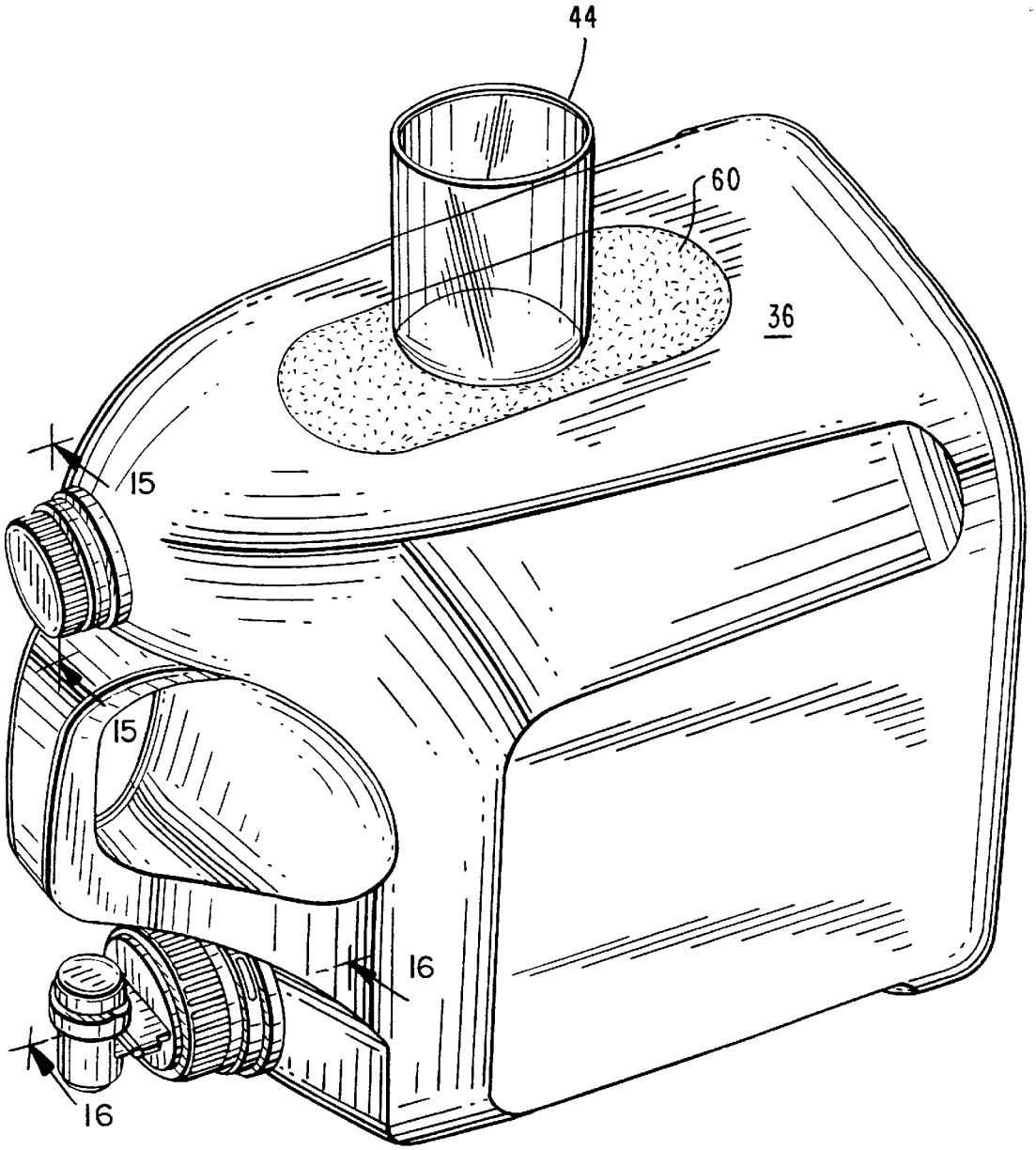
FIG. 14 is a perspective view of the bottle of FIG. 1 in the pouring position.

It will be appreciated that when the container is in its dispensing position resting on front wall 24, it may be desirable to rest momentarily measuring cup 44. Particularly in view of the anticipated large volume of the container, it will be tempting to rest the measuring cup on one of the walls of the container, especially the wall opposite the wall on which the container is resting. Since it is envisioned that the container may be made of a material, such as certain thermoplastics, which is relatively smooth, in accordance with the invention, a non uniform section may be provided within one of the walls to assist in maintaining the cup in its position while it is disposed on the container. An example is illustrated in FIG. 14 wherein surface 60 which has a racetrack-like periphery, has been etched into rear wall 36. This is expected to minimize any tendency of measuring cup 44 to slip or slide on the surface of the container. Front panel 24 includes a large flat area to provide a stable base and to resist rocking during the dispensing operation. The side of the bottle adjacent the top vent closure becomes the top of the bottle in the dispensing position. This panel 36 is flat and level and has the textured surface wherein the measuring, cup can be placed between uses in the upright position.

Measuring cup 44 serves the dual function of measuring cup and closure for the spigot assembly. Measuring cup 44 is releasably secured to the container in its inverted position by being snap fit over equi-spaced ribs or lugs 96, which mate with bead 190 at the mouth of the cup. Alternatively, the measuring cup can be secured to the bottle base finish by use of a continuous thread to screw on the bottle base finish or by other means.

The cup's annular bead and the bottle's three or more lugs are designed to stay engaged during the impact of case packing as well to as withstand the rigors of shipping and warehousing without becoming dislodged.

The container may be mono-layer or multi-layer and may be made of HDPE, PP, PVC, PET, POLYCARBONATE or acrylic or nitrite base resins, and preferably contains a minimum of 25% PCR.

Preferably, the measuring cup has textured fill line bands etched into the interior of the cup to aid the consumer visually in filling to the proper dose. The measuring cup may have a v-groove channel on the exterior of the mouth, similar to a laboratory beaker, to aid in pretreating strains with precise pouring. This channel could have an anti-drip lip. Alternatively, there may be "V" or "U" notches in the top side wall for a controlled pour.

If so desired, the measuring cup can include a handle. The measuring cup could have an exterior, annular anti-drip lip.

The container or bottle of the inventions may be pigmented opaque or may be made clear by fabricating it from clarified grades of the aforementioned resins.

In addition to the vertical side panels, including the side panels at the vertical corner intersections, there may be other strengthening vertical design features such as outer ribs or inner grooves either at the corner intersections or elsewhere in the side panels, or at in both locations.

The bottle, valve, valve collar and vent closure may be made of anti-static grades of the aforementioned resins. The tap collar and vent closure are preferably made of a polyolefin resin, most preferably PP. Preferably, the pigmented tap body is the same color as the pigmented tap collar and vent closure. Alternatively, these components may be clear and the measuring cup could be opaque.

Preferably, the front and back panels of the bottle include in-mold labels (IML labels), preferably plastic IML's. Plastic IML's may be opaque or clear. Polypropylene (PP) IMLs may be used to reduce blistering given that the containers of the invention may have a relatively large label area. Alternatively, instead of an IML, there may be a stretch or shrink label which act like a "girdle" to resist bottle bulging with these labels. Also, the bottles front/back panels may be waffled.

There may be indicia cut into the molds and/or embossed on the molded bottle and vent closure which give instructions on use.

In an alternative design, the vent closure and the second bottle neck finish are in the same horizontal place as said first neck finish. In this configuration, the measuring cup may be attached to lugs at the base of the second neck finish and positioned over the vent closure.

To avoid label scuffing, the base of the bottle could be larger in length and thickness than the label panel's greatest length and thickness, so that labels would not contact the walls of the corrugated shipping container or the label of another bottle.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A system comprising a) a container having an opening, and b) a valve in fluid communication with said opening and adapted to be secured to said container by a separate collar, c) said valve including at least one depending lug which is received within lug confining walls on a finish of said container.

2. The system according to claim 1 wherein said valve is a spigot.

3. The system according to claim 1 wherein said collar includes threads which are complementary with threads on said container.

4. The system according to claim 3 wherein said container threads are disposed on a finish of said container.

5. The system according to claim 1 wherein said valve includes a base and said base is secured to said container by said collar.

6. The system according to claim 5 wherein said collar includes an annular flange which retains the valve base on said container.

7. The system according to claim 6 wherein said container has a neck and said opening is in said neck and said valve base is received within said opening.

8. The system according to claim 6 wherein said collar further comprises a cylindrical wall depending from said annular flange.

9. The system according to claim 6 wherein said valve base includes an annular recess which receives said annular flange of said collar.

10. The system according to claim 1 wherein said valve includes a valve head, and a valve seat against which said valve head is urged when said valve is closed.

11. The system according to claim 10 wherein said valve head is connected to a valve stem which is associated with a resilient valve actuator which urges said valve head against said valve seat when said valve is closed.

12. The system according to claim 11 wherein the valve actuator is a button.

13. The system according to claim 1 wherein said valve includes at least one wing for grasping the valve.

14. The system according to claim 1 further comprising ratchets on a finish of said container which act with complementary ratchets on said collar to lock said collar onto said container.

15. A valve assembly which comprises at least two separate pieces, the first comprising a valve and the second comprising a collar for securing said valve to a container, said valve including at least one depending lug which is adapted to be received within at least one lug confining wall of said container.

16. The valve assembly according to claim 15 wherein said valve is a spigot.

17. The valve assembly according to claim 15 wherein said collar includes fastening threads.

18. The valve assembly according to claim 17 wherein said collar threads are adapted to mate with container threads disposed on a finish of said container.

19. The valve assembly according to claim 15 wherein said valve includes a base suitable for being secured to said container by said collar.

20. The valve assembly according to claim 15 wherein said collar includes an annular flange for retaining the valve on said container.

21. The valve assembly according to claim 20 wherein said valve base includes a recess which receives said annular flange of said collar.

22. The valve assembly according to claim 20 wherein said collar further comprises a cylindrical wall depending from said annular flange.

23. The valve assembly according to claim 15 wherein said valve includes a valve head, and a valve seat against which said valve head is urged when said valve is closed.

24. The valve assembly according to claim 23 wherein said valve head is connected to a valve stem which is associated with a resilient valve actuator which urges said valve head against said valve seat when said valve is closed.

25. The value assembly according to claim 24 wherein the valve actuator is a button.

26. The valve assembly according to claim 15 wherein said valve includes wings for grasping the valve.

27. The valve assembly according to claim 15 further comprising ratchets on said collar which are adapted to act with complementary ratchets on a finish on said container to lock said collar onto said container.

28. The valve assembly according to claim 15 which comprises at least four separate pieces, said pieces comprising a combined valve head and stem, a resilient valve actuator, a valve housing and the collar.

29. The valve assembly according to claim 15 wherein said valve and said collar are of the same color.

* * * * *